United States Patent [19]

DeBoo et al.

[11] 4,197,023

[45] Apr. 8, 1980

[54] FLEXIBLE PAPER GUIDING APPARATUS

[75] Inventors: Jerome L. DeBoo, Barrington; Werner Jung, Morton Grove, both of Ill.

[73] Assignee: Teletype Corporation, Skokie, Ill.

[21] Appl. No.: 822,776

[22] Filed: Aug. 8, 1977

[51] Int. Cl.[2] ..... B41J 11/60

[52] U.S. Cl. ..... 400/578; 400/56; 400/124; 400/642; 400/647

[58] Field of Search ..... 400/55, 56, 124, 578, 400/642, 646, 647.1, 647

[56] References Cited

U.S. PATENT DOCUMENTS

| | | | |
|---|---|---|---|
| 582,328 | 5/1897 | Webb | 400/56 X |
| 1,160,459 | 11/1915 | Smith | 400/647 |
| 1,997,077 | 4/1935 | Racz et al. | 400/642 X |
| 3,982,622 | 9/1976 | Bellino et al. | 400/124 |
| 4,024,940 | 5/1977 | Hendrischk et al. | 400/56 |

FOREIGN PATENT DOCUMENTS

| | | | |
|---|---|---|---|
| 449407 | 9/1927 | Fed. Rep. of Germany | 400/647.1 |
| 2339630 | 2/1974 | Fed. Rep. of Germany | 400/124 |
| 2296530 | 7/1976 | France | 400/642 |

*Primary Examiner*—Ernest T. Wright, Jr.
*Attorney, Agent, or Firm*—A. A. Tirva; J. C. Albrecht

[57] ABSTRACT

A paper guide extends around the platen of a printing machine and has a flexible extension which bears against the front of the moving printing mechanism included in the printing machine. The close proximity of the paper guide to the printing mechanism of the printing machine serves to guide the paper as closely as possible into the small gap between the printing head and the platen and also to guide the paper as accurately as possible out through the paper-exit opening of the cabinet of the printing machine. Being so closely guided (particularly in the case of multiple sheet carbon set-ups or the joints of fan-fold paper), the leading edge or a fold of the paper is less likely to catch on the ribbon or get caught on the edge of the paper-exit opening of the cabinet. The flexible final guide extends so high up the printing mechanism side of the platen that it actually bears against the printing head and is flexibly deflected by the printing head as the printing head moves across the front of the platen.

1 Claim, 4 Drawing Figures

FLEXIBLE PAPER GUIDING APPARATUS

FIELD OF THE INVENTION

The present invention relates to printing machines and apparatus and more particularly to an apparatus for guiding the record medium so as to prevent the record medium from snagging, catching, smudging, or jamming as it progresses through and out of the printing apparatus.

BACKGROUND OF THE INVENTION

In wire matrix and other types of high-speed printing apparatus, such as that disclosed in U.S. Pat. 3,982,622, granted on Sep. 28, 1976, to J. A. Bellino, et al., the printing mechanism is positioned very close to the platen. An inked ribbon is positioned very close to the printing mechanism, between the printing mechanism and the platen. The paper which rests against the platen has very little clearance between the surface of the platen and the ribbon. This is an excellent arrangement for high speed matrix printing but leads to difficult paper insertion because of the very limited space between the ribbon and the platen.

Also, when the printing apparatus is mounted in a cabinet, the cabinet usually includes a paper-exit opening by which the printed paper can exit the cabinet. For aesthetic as well as practical reasons such as noise control, structural integrity, and operator safety, the paper-exit opening should be as small as possible. Such a desirably small opening exposes as little as possible of the interior machinery of the printing apparatus to the hazards of damage or the possibility of injury to an operator or others.

However, when the paper-exit opening is small, there is a great possibility that the leading edges of a sheet of paper, as it is inserted in the printing apparatus and advanced by rotation of the platen past the printing location and toward the paper-exit opening, will not always properly exit the machine cabinet but may jam by catching on the edge of the opening. This is particularly troublesome when the printing apparatus is operating unattended.

In conventional typewriters, as in the case of the IBM Executive, a sheet metal guide is arranged to hold the paper near the platen in an arcuate shape around the bottom of the platen. A second piece of sheet metal may actually bear against the platen and guide the paper very closely to the platen as the paper reaches the front of the platen, facing the keyboard. However, in the short length of the leading edge of the paper that extends from this final paper guide into the printing area, the paper is sufficiently rigid to extend tangentially from the platen. This cantilevered extension of the paper as the leading edge of the paper approaches the printing position is not a problem in a conventional typewriter with the ribbon and type bars placed a sufficient distance away from the platen and wherein the platen is very much exposed with the top of the paper eventually squeezed between the platen and a pair of upper guide rollers to keep the paper out of the way.

However, in the case of a printing apparatus in accordance with the abovementioned Bellino et al. patent, the printing apparatus with its platen and its facing inked ribbon is preferably enclosed within a cabinet. Therefore, the cantilevered, tangential extension of the paper is sufficient to catch and snag on the inked ribbon and perhaps jam on the edge of the paper-exit opening upon paper insertion. This is particularly a problem with multicarbon set-ups fed into the printer. Additionally, in the case of fan-fold paper in which the sections of the paper are connected by flexible paper hinges, these hinges tend to extend tangentially from the platen and may drag along the inked ribbon that extends across the width of the printing apparatus and these hinges may become unacceptably ink-smeared.

SUMMARY OF THE INVENTION

The present invention relates to a printing machine having a printing mechanism with a printing face and means for supporting a record medium adjacent the printing face wherein the printing mechanism experiences relative motion with respect to said supporting means, a rigid member guides the record medium into the vicinity of the printing mechanism, wherein the record medium extends generally between the supporting means and the rigid member and a flexible extension on the rigid member has a free position in interfering relationship with the principles face of the printing mechanism and bends only in the area of the printing mechanism to bear against the printing face of the printing mechanism and assumes a location at least partly between the printing face of the printing mechanism and the record medium, said flexible extension advantageously finally guiding the record medium evenly and as far as possible about the platen without interfering with the operation of the actual printing mechanism.

BRIEF DESCRIPTION OF THE DRAWING

A more complete understanding of the present invention may be had by referring to the following detailed description when considered in conjunction with the accompanying drawing wherein like reference numbers to the same or similar parts throughout the several views in which.

DETAILED DESCRIPTION

Figure 1:
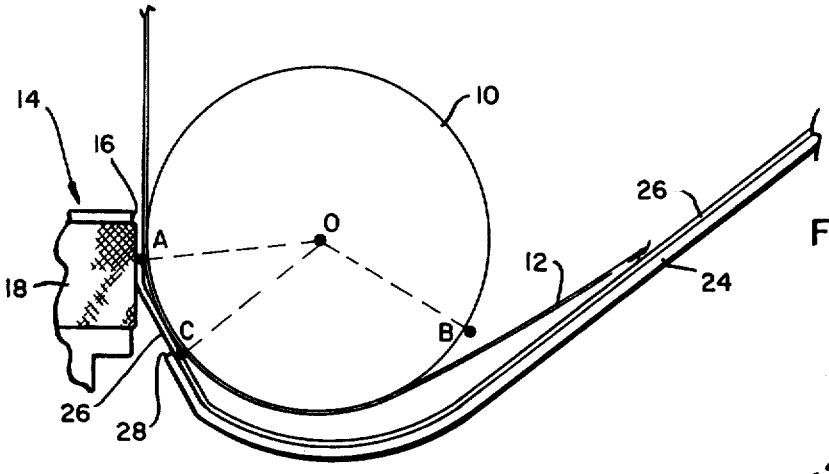
FIG. 1 illustrates a first embodiment of the present invention.

Referring now to the accompanying drawing and more particularly to FIG. 1, a cylindrical platen 10 carries and supports a paper record medium 12 for presentation to a printing mechanism 14. The printing mechanism 14 is preferably of the type shown in the abovementioned Bellino et al. patent. This printing mechanism 14 has a printing face 16 across which is stretched an inked ribbon 18 which is guided somewhat farther away from the platen 10 anywhere other than at the momentary location of the printing mechanism 14. Wires (not shown) actuated within the printing mechanism 14 from time to time momentarily project from the printing face 16 and squeeze the inked ribbon 18 and paper 12 against the platen 10 in order to mark indicia on the paper 12.

When a new sheet of paper 12 is inserted into the printing machine (not shown) it is squeezed between the platen 10 and pressure rollers (not shown) beneath the platen 10 such that rotation of the platen 10 assures that the paper 12 is carried with the platen 10 as it rotates. However, the paper 12 possesses a moderate amount of stiffness which will vary with many factors including ambient humidity and has a tendency to extend tangentially from the platen 10 at any location at which it is not closely guided to a desired path. Therefore, a rigid steel paper-guiding chute 24 is firmly mounted to the framework of the machine (not shown) and guides the paper 12 into engagement with the platen 10 as the paper 12 is inserted. The rigid chute 24 is cyclindrically shaped and extends around the lower portion of the cylindrical platen 10 from a position opposite an imaginary line B, which extends along the length of the platen 10 and is substantially parallel to the longitudinal axis O of the platen 10, to a position opposite an imaginary line C which extends along the length of the platen 10 and is parallel to but remote from line B such that chute 24 stops well short of the printing mechanism 14 to avoid interference therewith.

A flexible plastic sheet member 26 is bonded to the surface of the rigid guiding chute 24 that is closest to the platen 10. Without the plastic member 26, the leading edge of the paper 12 would extend in a line tangent to the platen 10 as determined by the end 28 of the rigid guiding chute 24. This tangent extension of the cantilevered end of the paper 12 might well impinge at a fairly steep angle on the ribbon 18. Therefore, as the paper 12 is advanced by the rotating platen 10, the paper 12 might push the ribbon 18 up and away from the printing face 16. Alternatively, the leading edge of the paper 12 or a fold in a length of fan-fold paper could wipe at a fairly steep angle across the inked ribbon 18 and thus become ink smudged.

The platen 10 is preferably quite wide, and the printing mechanism 14 traverses from one end of the platen to 10 to the other in order to span the width of the paper 12 and print rows of alphanumeric indicia thereon. When the printing mechanism 14 is at its customary idle location near the left margin of the paper 12 on the platen 10, the rightmost edge of the paper 12 is unsupported beyond the end 28 of the rigid member 24 except for the plastic member 26 and without the plastic member 26, the paper 12 may thus tend to jam. However, the plastic member 26 extends well beyond the end 28 of the rigid guiding chute 24 which end 28 is located opposite the imaginary line C, to a position opposite an imaginary line A which is parallel to but remote from lines B and C and extends along the length of the platen 10 immediately below the printing position on the record medium 12 such that the member 26 actually touches the ribbon 18 on the printing face 16.

The leading edge of a piece of paper 12 is thus prevented from impinging on the ribbon 18 at a steep angle and is closely guided to the platen 10 all along its width. Therefore, there is less chance that the paper 12 will touch the ribbon 18 at any point other than at the printing face 16, and the paper 12 is closely guided out through the paper-exit opening (not shown).

The portion of the plastic member 26 that extends beyond the end 28 of the rigid guiding chute 24 is sufficiently flexible that it can be designed to extend as far around the platen 10 as possible; because, it can readily bend out of its normal straight shape when it interferes with the printing mechanism 14 and the ribbon 18. Naturally, this bent position of the plastic member 26 exists only in the immediate region of the temporary location of the moving printing mechanism 14. As the printing mechanism 14 traverses from one end to the other of the platen 10, it bends the flexible plastic member 26 only in the location where the printing mechanism 14 is instantaneously in interference with the plastic member 26.

Figure 2:
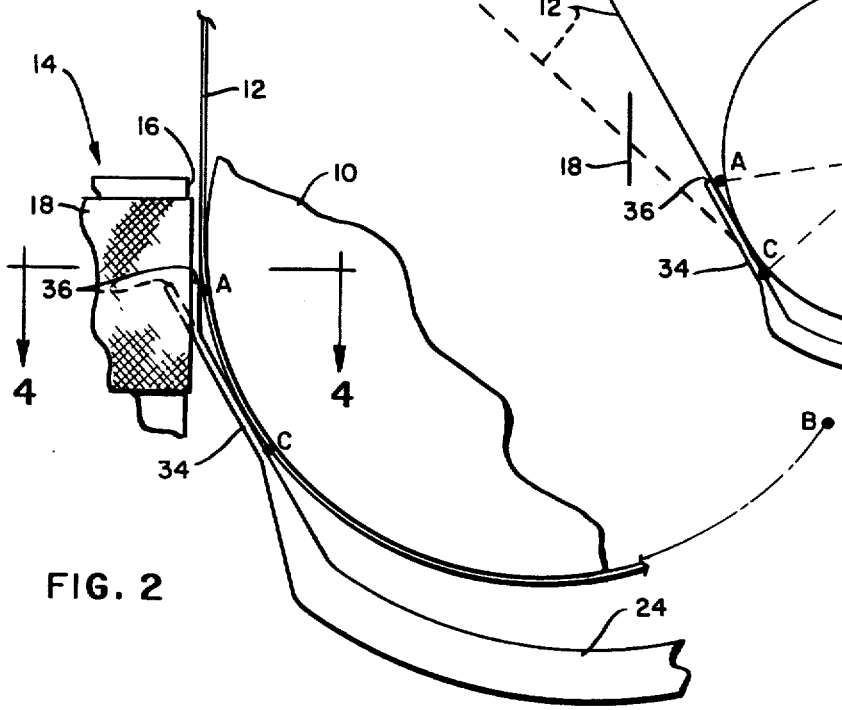
FIG. 2 illustrates a second embodiment of the present invention.

Referring now to FIG. 2, the only difference between FIG. 1 and FIG. 2 is in the preferred makeup of the rigid guiding chute 24 and a flexible member 34 extending therefrom. While a rigid sheet of steel is preferably used for the rigid guiding chute 24 of FIG. 1, the rigid guiding chute 24 of FIG. 2 is made out of basically fairly flexible plastic material. However, the chute 24 of FIG. 2 is made with such thick cross section in the region below the platen 10 that it is for all practical purposes quite rigid. However, the rigid guiding chute 24 of FIG. 2 has integrally formed with it the flexible extension 34 of much thinner cross section which extends from he thick cross section of the rigid guiding chute 24 and as with the plastic member 26 of FIG. 1, the flexible extension 34 is long enough to engage the inked ribbon 18 and the printing mechanism 14.

The parts of the printing mechanism 14 and chute 24 are shown somewhat enlarged in FIG. 2 from the scale shown in FIG. 1 and illustrate in dotted lines the normal position of an end 36 of the flexible extension 34 in the absence of the printing mechanism 14 to guide the paper 12 as closely as possible to the platen 10 and as high as possible in front of the printing mechanism 14 to direct the paper 12 through a paper-exit opening (not shown). However, in the area where the printing mechanism 14 is temporarily located along the length of the platen 10, the end 36 of the flexible extension 34 bends to accomodate the printing face 16 and the ribbon 18. This bending of the flexible extension 34 assures that the extension 34 extends as far up the face of the platen 10 as possible without actually interfering with the print wires (not shown) as they squeeze the ribbon 18 onto the paper 12.

Figure 3:
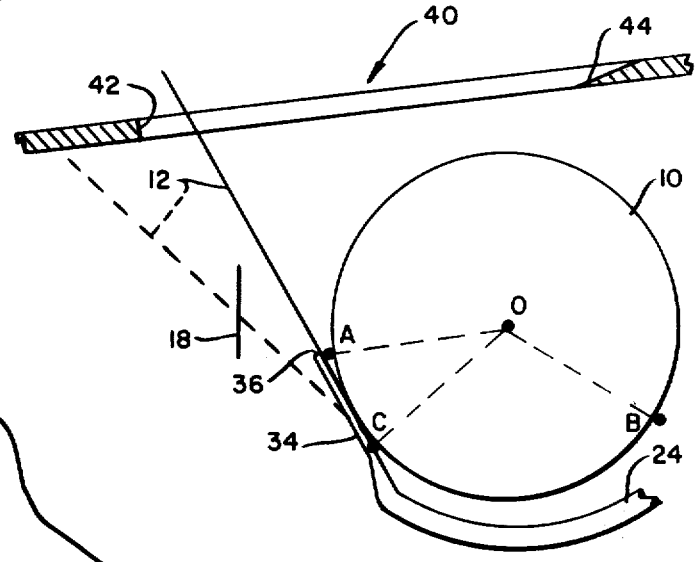
FIG. 3 illustrates how the second embodiment of the present invention keeps paper from jamming on the edge of the paper-exit opening of the printing-apparatus cabinet.

Referring now to FIG. 3, the same rigid guiding chute 24 is shown in FIG. 2. However, the view of FIG. 3 is less enlarged than in FIG. 2 and also shows a fragmentary section of the cover of the printing machine (not shown) illustrating a paper-exit opening 40 having two edges 42 and 44. It is essential, in the operation of the printing machine, that the paper 12 is guided by the flexible extension 34 so that the paper 12 safely passes the edge 42 (as shown in solid lines in FIG. 3) at any location along the width of the paper 12, no matter where the printing mechanism 14 may monemtarily be located.

If the flexible extension 34 did not extend as far up on the front of the platen 10, an edge of the paper 12 might reasonably be expected to assume the path indicated by the dotted lines in FIG. 3. The dotted path of the paper 12 can readily be seen to possibly interfere with a length of the inked ribbon 18 which might well cause smudging of the paper 12. The dotted path of the paper 12 clearly illustrates that the paper exit opening 40 would have to be much larger to assure that the leading edge of a piece of paper 12 would reliably exit from the printer (not shown) without catching on the edge 42 and jamming. The flexible extension 34 clearly constrains the paper 12 to the highest possible point without acutally interfering with the operation of the printing mechanism 14.

Figure 4:
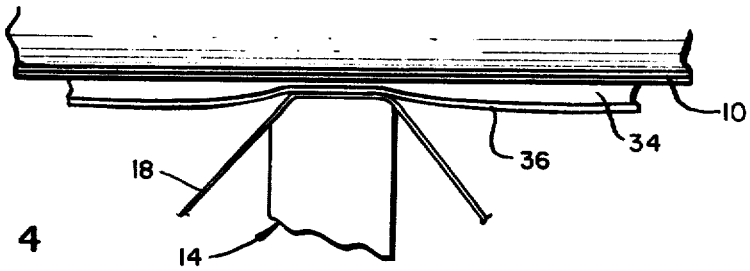
FIG. 4 is a reduced plan view in cross section taken along line 4—4 of FIG. 2.

Referring now to FIG. 4, the platen 10 and the printing mechanism 14 are shown in plan view on a somewhat smaller scale than in FIG. 2 and with the end 36 of the flexible extension 34 shown extending between the platen 10 and the printing mechanism 14. It is most evident from the view of FIG. 4 that for the major proportion of the length of the platen 10 as well as the length of the chute 24 and its flexible extension 34, the extension 34 goes so high as to impinge upon the face 16 of the printing mechanism 14 so that wherever the printing mechanism 14 is located along the length of the extension 34 its edge 36 is temporarily bent toward the platen 10. Therefore, the paper 12 is always guided as closely as possible between the platen 10 and the ribbon 18 and as high as possible in front of the platen 10.

It will again be evident that the actual printing wires (not shown) issue from the printing face 16 above the edge 36, as seen in FIG. 2.

Although only two specific embodiments of the invention are shown in the drawing, and described in the foregoing specification, it will be understood that the invention is not limited to the specific emobidments described, but is capable of modification and rearrangement and substitution of parts and elements without departing from the spirit of the invention.

What is claimed is:

1. In a wire matrix printing machine comprising: a cylindrical platen for supporting a record medium; a printing mechanism arranged to move in a path of travel along the length of said platen a permitted distance, a plurality of printing wires, a printing face surrounding the wires and spaced apart a fixed distance from said platen; and a record medium giude comprising a unitary guiding surface affixed to the machine and extending along the length of said platen for a distance in excess of the permitted travel of said printing mechanism, said guiding surface extending about said platen from a first line along the length of the platen immediately below the printing position on the record medium such that a portion of the printing face below said printing wires engages a first edge of the guide opposite the first line but said print wires do not engage said guide, and said guide extends without interruption around but spaced apart from said platen to a position opposite a second line along the length of said platen, said second line being parallel to but remote from said first line such that the record medium may be introduced into the printing machine from behind the platen and brought into registration with the path of travel of the print face, said guide being rigid between the position at which the record medium is introduced and a third line along the length of the platen, said third line being parallel to and between but remote from said first and second lines such that the printing face does not engage said guide in the region of said third line; and the remainder of said guide between said first line and said third line being flexible such that said remainder portion of said guide conforms to the engaging portion of the printing face along the path of travel of the printing mechanism.—.

* * * * *